United States Patent [19]

Nojima

[11] Patent Number: 4,776,596

[45] Date of Patent: Oct. 11, 1988

[54] GOLF BALL HAVING BRAKING WING

[76] Inventor: Takashige Nojima, No. 15-16, 5-chome, Yanagisaki, Kawaguchi, Saitama, Japan

[21] Appl. No.: 40,834

[22] Filed: Apr. 7, 1987

[30] Foreign Application Priority Data

Apr. 7, 1986 [JP] Japan ..... 61-50936[U]
May 9, 1986 [JP] Japan ..... 61-68809[U]

[51] Int. Cl.[4] ..... A63B 69/36

[52] U.S. Cl. ..... 273/199 A; 273/176 A; 273/417

[58] Field of Search ..... 273/417, 199 A, 176 A, 273/420, 428, 58 K

[56] References Cited

U.S. PATENT DOCUMENTS

| | | | |
|---|---|---|---|
| 2,626,807 | 1/1953 | Carlton | 273/417 |
| 3,198,526 | 8/1965 | Smith et al. | 273/199 A |
| 3,437,340 | 4/1969 | Grise | 273/199 A |
| 3,752,479 | 8/1973 | Chung | 273/417 |

*Primary Examiner*—George J. Marlo
*Attorney, Agent, or Firm*—Browdy and Neimark

[57] ABSTRACT

A plastic golf ball including conventional dimples and a shuttlecock braking device. The ball may be hit into a target basket or onto a target mat marked with concentric circles.

2 Claims, 2 Drawing Sheets

GOLF BALL HAVING BRAKING WING

BACKGROUND OF THE INVENTION

1. Field of the Invention

This invention relates to a golf ball to be used in a changed new golf, and more particularly to a golf ball having a braking wing for a new golf where flying distances are much shortened.

2. Description of the Prior Art

In general, since the golf ball flies more than 200 m to the maximum, huge places are required for courses of 18 holes, and so golf courses are not easily arranged. Playing fees are expensive. As the golf ball of about 40 g in weight flies at fairly high speed, it is dangerous in the crowded golf places.

SUMMARY OF THE INVENTION

In view of these circumstances, it is an object of the present inevntion to propose a new sport with which the people may enjoy plays similar to the normal golf.

It is another object of the invention to propose a new golf ball having a braking wing which gives no danger to the people if the flying balls strike them.

It is a further object of the invention to propose a golf ball having a braking wing which enables stable flying.

Other and further objects, features and advantages of the invention will appear fully from the following description.

DETAILED DESCRIPTION OF THE PREFERRED EMBODIMENTS

The most preferable embodiment of the present invention will be described in detail with reference to the accompanying drawing.

Figure 1:
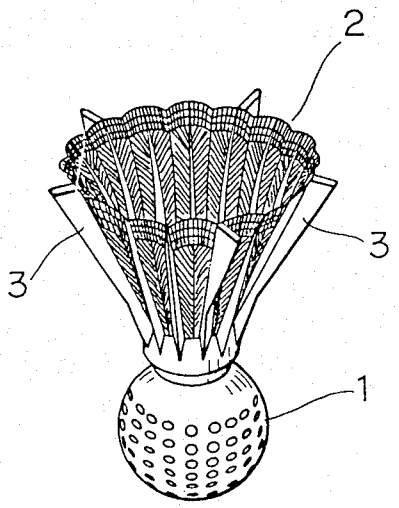
FIG. 1 is a perspective view showing one embodiment of a golf ball having a braking wing according to the invention.

The golf ball having a braking wing shown in FIG. 1 is composed of a ball 1 and a braking wing 2. The ball is plastic and around 40 mm in diameter, having many dimples as the ordinary ones. The braking wing 2 is expanded upwardly and secured to the ball on its surface just like a shuttle-cock of a badminton. Preferably, the braking wing 2 is provided with ribs 3 vertically. The shown braking wing 2 has the five ribs 3. The rib 3 prevents rolling or turning by the side wind when shotting, or rolling at the slope side. In addition. the rib 3 checks pitching during flying and keeps the stable flying and beauty of the flying.

Figure 3:
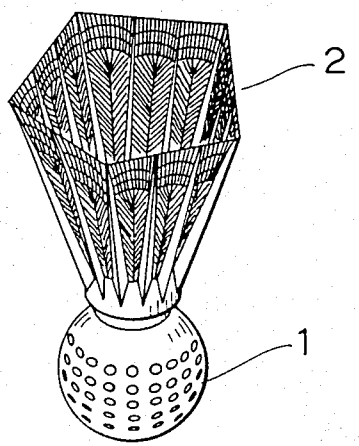
FIG. 3 is a perspective view of a further embodiment.
Figure 2:
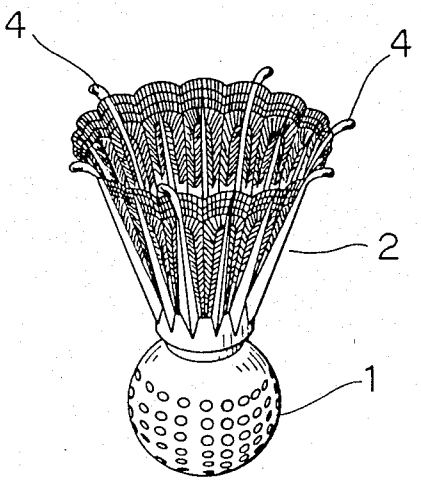
FIG. 2 is a perspective view showing another embodiment.

FIGS. 2 and 3 show other structures for preventing the rolling or turning of the ball. That is, a product shown in FIG. 2 has pawls 4 projecting from the upper end of the braking wing 2 for stopping turning or rolling of the ball 1. That of FIG. 3 makes the braking wing 2 polygonal (shown is pentagon) so as to have the same effect. The ball has weight of ½ of the normal one.

The braking wing 2 is faced forward and the ball 1 is hit. Since the flying distance is about 30 m at most even by a wood club, this changed new golf does not require a long hole up to 100 m.

Figure 4:
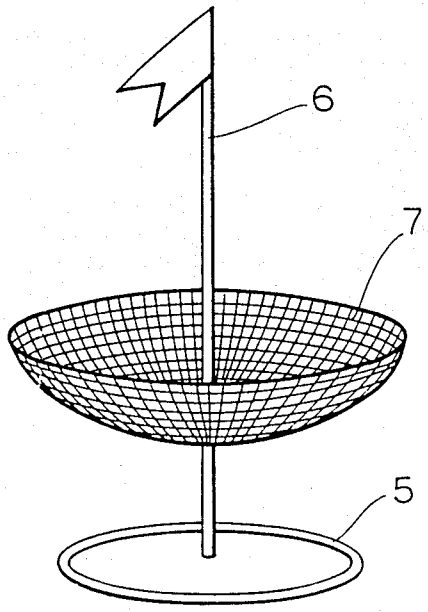
FIG. 4 is a perspective view showing a hole for a changed new golf according to the invention.

FIG. 4 shows a hole for a one play of the changed new golf. A pin 6 is stood at a center of a circle 5 on the ground, and a basket 7 is held on the pin 6.

When the ball falls into the basket 7 or the circle 5, it is a hole out, and hits up to at that time are scored. The players getting less scores are of course ranked higher. Since the player is better in getting into the circle 5 than the basket 7 and when the ball is got into the circle 5, the hitting number + one-hit is scored. A putter is not used. When starting the play, a tee may be used as the normal golf.

Figure 5:
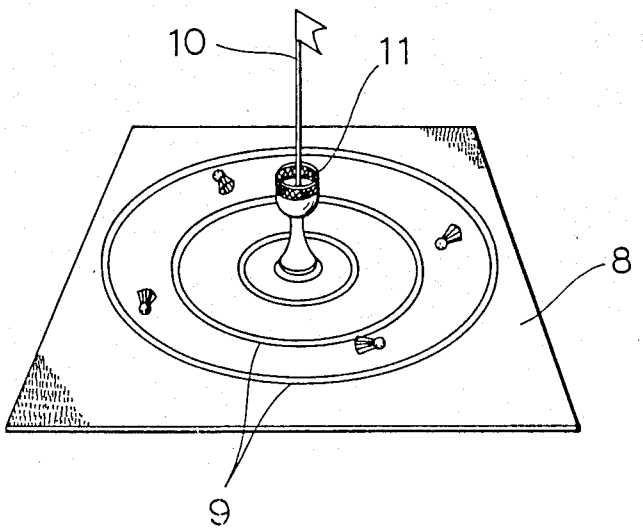
FIG. 5 is a perspective view showing target sheet for another playing rule.

FIG. 5 show another play. A target sheet is laid about 18 m before a shotting point. The target sheet is drawn with a plurality of coaxial circles 9, and each of the circles 9 is shown with a scoring point. Points become higher as going to the inside.

A basket 11 having a pin 10 is positioned at a center of a circle 9, and if the ball is got into the basket 11, a player may get the highest point. In this play, the players getting more scores are ranked higher.

In each of the above plays, since the players swing the golf clubs of the existing golf, they may practise their favorite golf The hit ball is rapidly speed-reduced and moderately falls down, and so it does not hurt other players. Only, unless being hit exactly as the foregoing golf, the ball does not fly in straight. All the above mentioned plays may be practised indoors.

What is claimed is:

1. A golf ball, wherein said ball is made of plastic having a plurality of depressions in its surface, and is provided with a shuttlecock braking means having a generally funnel shaped configuration, and a plurality of ribs projecting outwardly from said braking means.

2. A golf ball as claimed in claim 1, provided with five ribs.

* * * * *